US005471768A

United States Patent [19]

Pryor

[11] Patent Number: 5,471,768

[45] Date of Patent: Dec. 5, 1995

[54] SNEAKER WITH BUILT IN ATOMIZER FOR IMPROVED TRACTION

[76] Inventor: Gregory L. Pryor, #27 Woodland Dr., Conway, Ark. 72032

[21] Appl. No.: 225,763

[22] Filed: Apr. 11, 1994

[51] Int. Cl.[6] ..... A43B 7/06

[52] U.S. Cl. ..... 36/3 R; 36/1

[58] Field of Search ..... 36/1, 28, 29, 3 R, 36/3 B, 112, 116, 132, 136; 222/175, 78; 239/289, 211

[56] References Cited

U.S. PATENT DOCUMENTS

| | | | |
|---|---|---|---|
| 3,555,706 | 1/1971 | Edmonds . | |
| 4,008,530 | 2/1977 | Gager | 36/28 |
| 4,170,046 | 10/1979 | Mattison | 4/182 |
| 4,550,510 | 11/1985 | Stubblefield | 36/32 R |
| 4,682,715 | 7/1987 | Reeves | 222/175 |
| 4,762,433 | 8/1988 | Bergeson et al. | 401/206 |
| 4,887,367 | 12/1989 | Mackness et al. | 36/29 X |
| 5,148,949 | 9/1992 | Luca | 36/136 X |
| 5,185,942 | 2/1993 | Decker | 36/1 X |
| 5,335,430 | 8/1994 | Fiso et al. | 36/136 X |

*Primary Examiner*—Jimmy G. Foster
*Assistant Examiner*—BethAnne C. Cicconi

[57] ABSTRACT

A sneaker with built in atomizer for improved traction having a sole, an upper, a tongue and laces; an atomizer located in the upper tongue of the sneaker with built in atomizer for improved traction, the atomizer being formed in a hemispherical configuration with a valve and aperture centrally located on the upper surface thereof, the atomizer adapted to urge air therefrom upon depression and to allow the refilling thereof with air upon release of the atomizer, the atomizer including a first line coupling the interior of the atomizer with the input port of the reservoir whereby pressure within the atomizer is increased upon the depression of the atomizer; and a spray nozzle in fluid communication with the bottom of the sole of the sneaker with built in atomizer for improved traction and a second line extending from the nozzle through the output to a lower region of the interior of the reservoir whereby when the atomizer increases the pressure within the reservoir, the fluid therein will move through the output port to the spray nozzle where it will be released to the exterior of the shoe sole.

4 Claims, 3 Drawing Sheets

SNEAKER WITH BUILT IN ATOMIZER FOR IMPROVED TRACTION

BACKGROUND OF THE INVENTION

1. Field of the Invention

The present invention relates to a new and improved sneaker with built in atomizer for improved traction and, more particularly, pertains to improving the traction of athletes by incorporating an atomizer into a player's sneakers.

2. Description of the Prior Art

The use of sneakers with built in pumps for various functions is known in the prior art. More specifically, sneakers with built in pumps for various functions heretofore devised and utilized for the purpose of atomizing liquids for a wide variety of purposes are known to consist basically of familiar, expected, and obvious structural configurations, notwithstanding the myriad of designs encompassed by the crowded prior art which has been developed for the fulfillment of countless objectives and requirements.

The prior art discloses a large number of sneakers with built in pumps for various functions. By way of example, U.S. Pat. No. 3,555,706 to Edmonds discloses athletic footwear particularly basketball shoes.

U.S. Pat. No. 4,170,046 to Mattison discloses a foot liquid dispenser.

U.S. Pat. No. 4,550,510 to Stubblefield discloses a basketball shoe sole.

U.S. Pat. No. 4,682,715 to Reeves discloses a detachable shoe-lure dispenser.

U.S. Pat. No. 4,762,433 to Bergeson discloses a fluid applicator for shoes and the like.

Lastly, U.S. Pat. No. 5,148,949 to Luca discloses a detachable dispenser for distributing scent or lure.

In this respect, the sneaker with built in atomizer for improved traction according to the present invention substantially departs from the conventional concepts and designs of the prior art, and in doing so provides an apparatus primarily developed for the purpose of improving the traction of athletes by incorporating an atomizer into a player's sneakers.

Therefore, it can be appreciated that there exists a continuing need for a new and improved sneaker with built in atomizer for improved traction which can be used for improving the traction of athletes by incorporating an atomizer into a player's sneakers. In this regard, the present invention substantially fulfills this need.

SUMMARY OF THE INVENTION

In view of the foregoing disadvantages inherent in the known types of sneakers with built in pumps for various functions now present in the prior art, the present invention provides a new and improved sneaker with built in atomizer for improved traction. As such, the general purpose of the present invention, which will be described subsequently in greater detail, is to provide a new and improved sneaker with built in atomizer for improved traction and methods which have all the advantages of the prior art and none of the disadvantages.

To attain this, the present invention essentially comprises a new and improved sneaker with built in atomizer for improved traction comprising, in combination, a sneaker with built in atomizer for improved traction having a sole, an upper, a tongue and laces; a reservoir for liquid integrally formed on the inner surface of the sneaker with built in atomizer for improved traction, the reservoir being fabricated of a fluid-impervious material with an air input port and a vapor output port and a spring loaded cap extending through an aperture thereof for communicating with exterior of the sneaker with built in atomizer for improved traction, the cap including a spring urging the cap into a closed position for sealing the fluid within the reservoir and adapted to be moved to a loading position for providing supplemental fluid to the reservoir; a liquid container with a rigid snout adapted to contact and depress to the cap to the loading position, the container having resilient side walls for being squeezed to dispense liquid from the container through the snout into the reservoir for supplementing the fluid therein when the snout is contacting and depressing the cap; an atomizer located in the upper tongue of the sneaker with built in atomizer for improved traction, the atomizer being formed in a hemispherical configuration with a ball-check valve and aperture centrally located on the upper surface thereof, the atomizer adapted to urge air therefrom upon depression and to allow the refilling thereof with air upon release of the atomizer, the atomizer including a first line coupling the interior of the atomizer with the input port of the reservoir whereby pressure within the atomizer is increased upon the depression of the atomizer; and a spray nozzle in fluid communication with the bottom of the sole of the sneaker with built in atomizer for improved traction adjacent to a forward extent thereof, and a second line extending from the nozzle through the output to a lower region of the interior of the reservoir whereby when the atomizer increases the pressure within the reservoir, the fluid therein will move through the second line to the nozzle for being dispensed therethrough as a vapor for moistening the lower surface of the sole to increase the traction thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sneaker with built in atomizer for improved traction which has all the advantages of the prior art sneakers with built in pumps for various functions and none of the disadvantages.

It is another object of the present invention to provide a new and improved sneaker with built in atomizer for improved traction which may be easily and efficiently manufactured and marketed.

It is a further object of the present invention to provide a new and improved sneaker with built in atomizer for improved traction which is of a durable and reliable construction.

An even further object of the present invention is to provide a new and improved sneaker with built in atomizer for improved traction which is susceptible of a low cost of manufacture with regard to both materials and labor, and which accordingly is then susceptible of low prices of sale to the consuming public, thereby making such a sneaker with built in atomizer for improved traction economically available to the buying public.

Still yet another object of the present invention is to provide a new and improved sneaker with built in atomizer for improved traction which provides in the apparatuses and methods of the prior art some of the advantages thereof, while simultaneously overcoming some of the disadvantages normally associated therewith.

Even still another object of the present invention is to improve the traction of athletes by incorporating an atomizer into a player's sneakers.

Lastly, it is an object of the present invention to provide a sneaker with built in atomizer for improved traction comprising a sneaker with built in atomizer for improved traction having a sole, an upper, a tongue and laces; an atomizer located in the upper tongue of the sneaker with built in atomizer for improved traction, the atomizer being formed in a hemispherical configuration with a valve and aperture centrally located on the upper surface thereof, the atomizer adapted to urge air therefrom upon depression and to allow the refilling thereof with air upon release of the atomizer, the atomizer including a first line coupling the interior of the atomizer with the input port of the reservoir whereby pressure within the atomizer is increased upon the depression of the atomizer; and a spray nozzle in fluid communication with the bottom of the sole of the sneaker with built in atomizer for improved traction and a second line extending from the nozzle through the output to a lower region of the interior of the reservoir whereby when the atomizer increases the pressure within the reservoir, the fluid therein will move through the second line to the nozzle for being dispensed therethrough as a vapor for moistening the lower surface of the sole to increase the traction thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
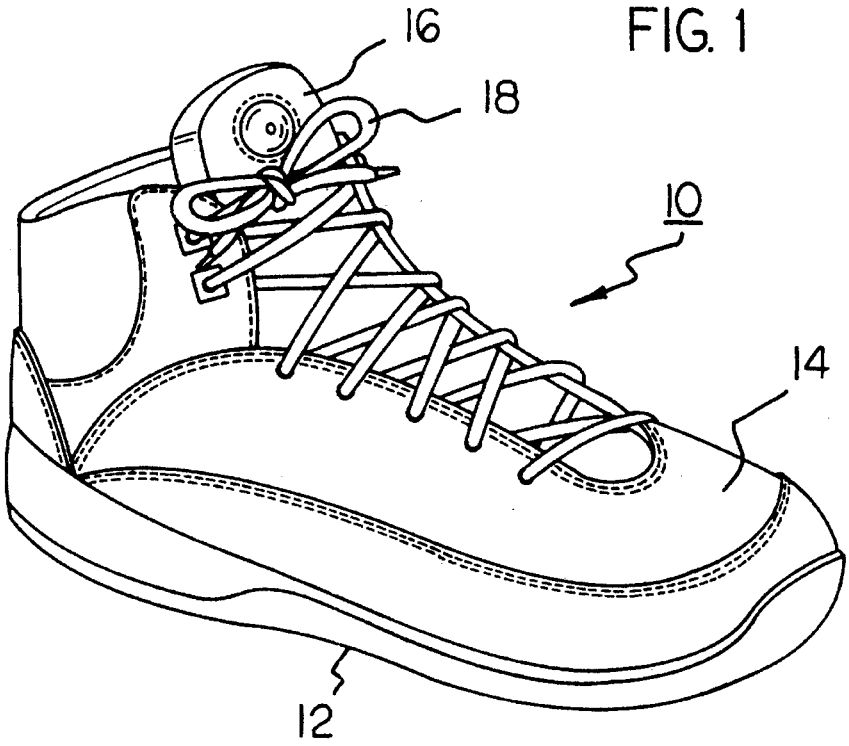
FIG. 1 is a perspective illustration of the preferred embodiment of the sneaker with built in atomizer for improved traction constructed in accordance with the principles of the present invention.
Figure 2:
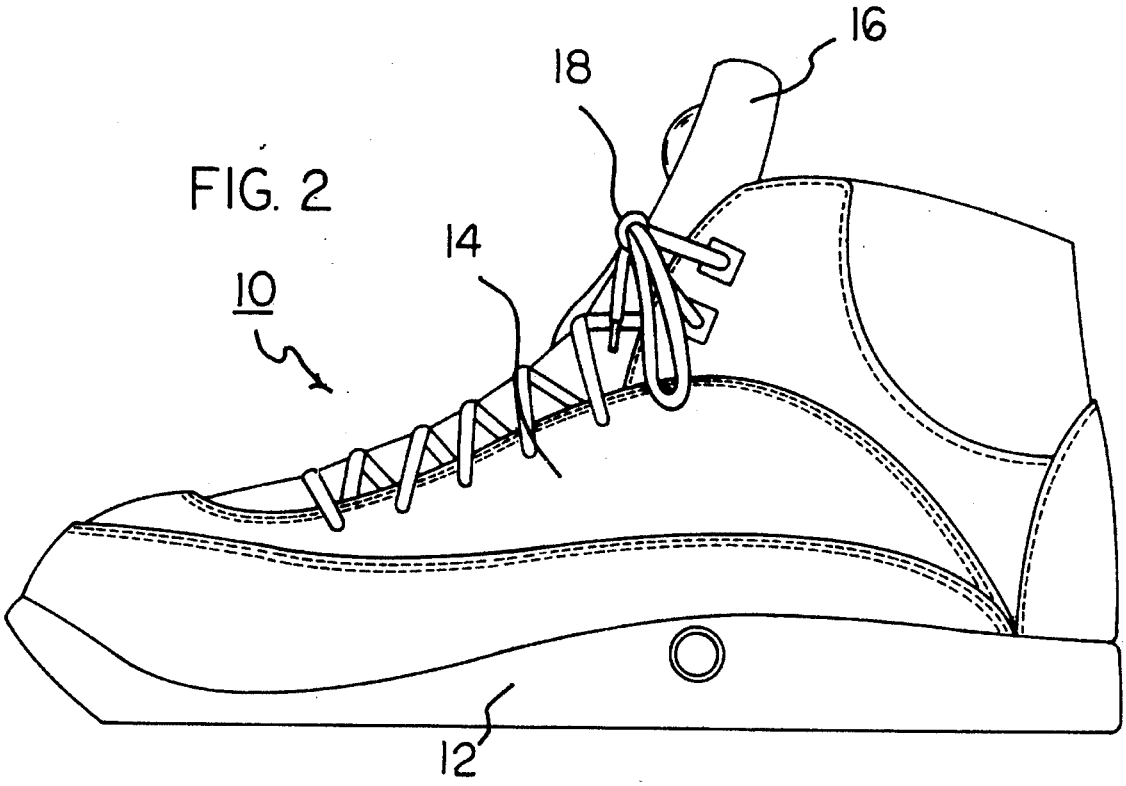
FIG. 2 is a side elevational view of the sneaker with built in atomizer for improved traction illustrated in FIG. 1.
Figure 3:
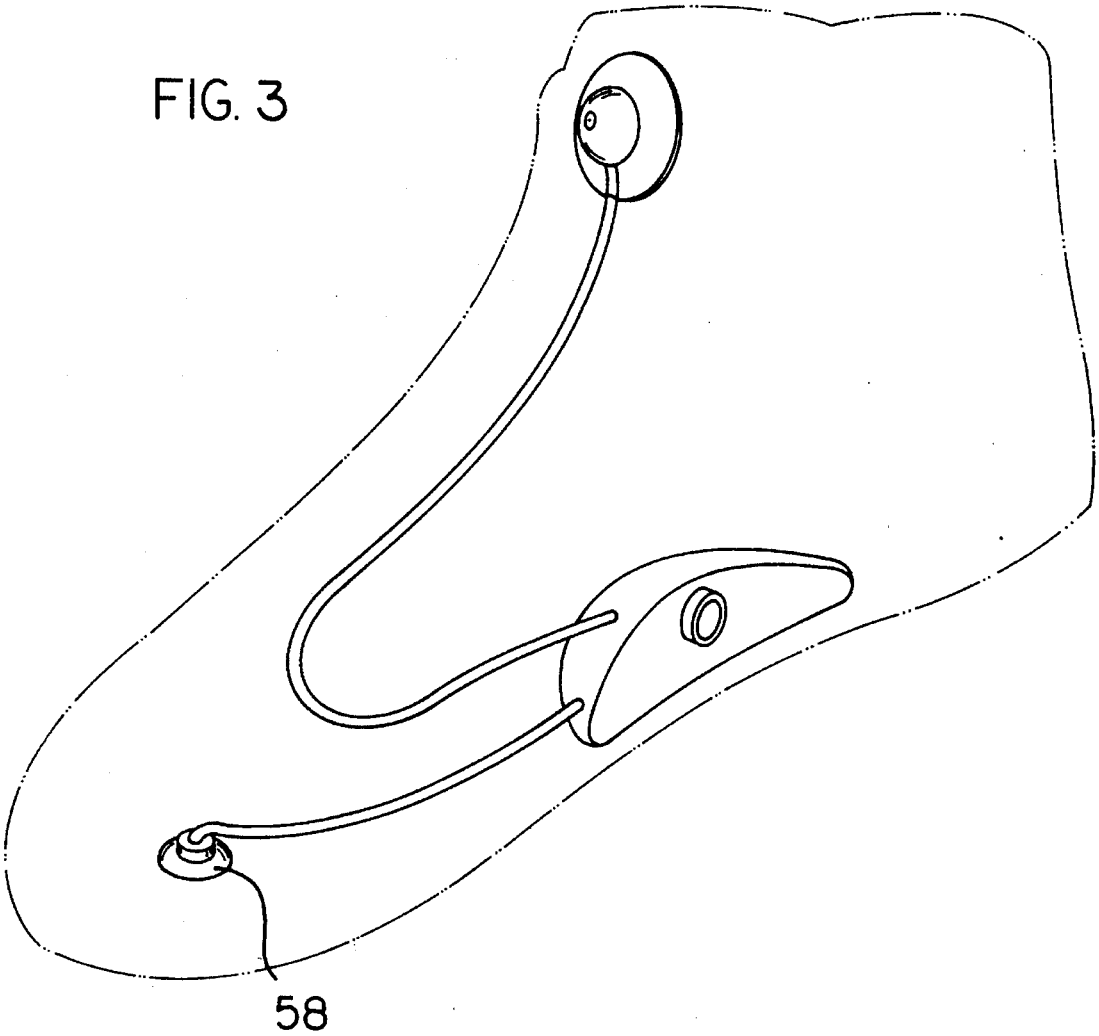
FIG. 3 is a perspective illustration of the atomizer system employed in the shoe of the prior Figures.
Figure 4:
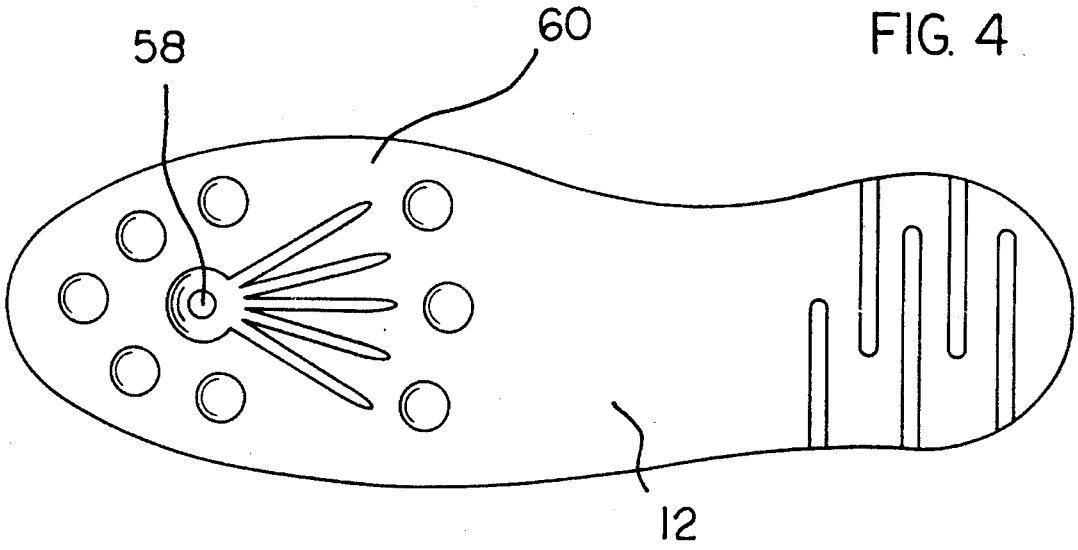
FIG. 4 is a bottom elevational view of the sneaker with built in atomizer for improved traction illustrated in the prior Figures.
Figure 5:
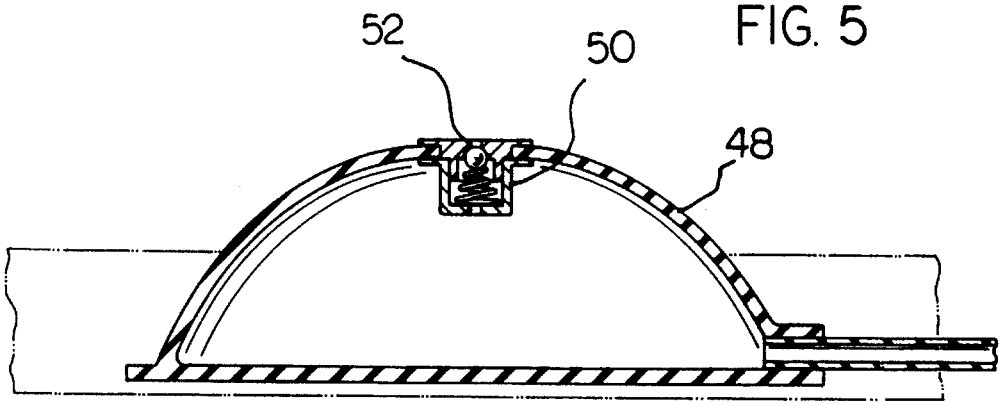
FIG. 5 is a cross-sectional view of the actuator illustrated in the prior Figures.
Figure 6:
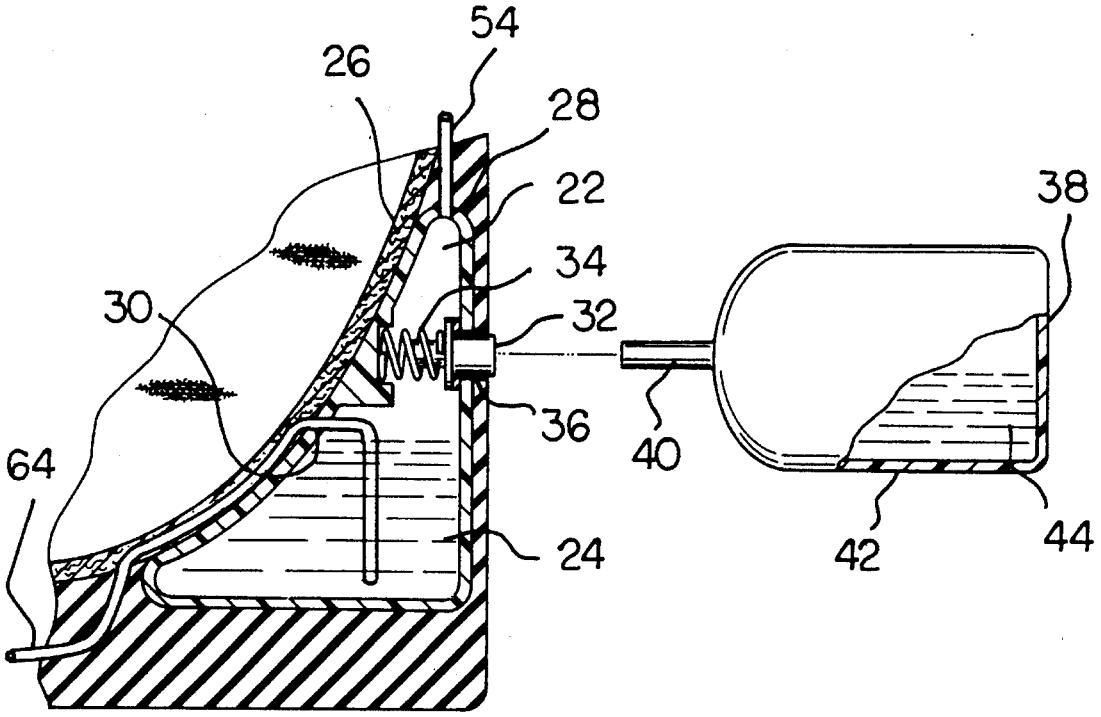
FIG. 6 is an exploded perspective view of the reservoir of FIGS. 2 and 3 illustrating the loading thereof.

With reference now to the drawings, and in particular to FIGS. 1 through 6 thereof, the preferred embodiment of the new and improved sneaker with built in atomizer for improved traction embodying the principles and concepts of the present invention and generally designated by the reference numeral 10 will be described.

The present invention, the new and improved sneaker with built in atomizer for improved traction is a system comprised of a plurality of component elements. Such component elements, in their broadest context, include a sneaker, a reservoir, a liquid container, an atomizer and a spray nozzle. Such component elements are individually configured and correlated one with respect to the other so as to attain the desired objectives.

More specifically, the sneaker 10 of the present invention looks at first appearance to be of a conventional construction. It includes a sole 12, an upper 14, a tongue 16 and laces 18. The sneakers intended to be sold as pairs in the normal fashion.

Next included in the sneaker is a reservoir 22. The reservoir is for a liquid 24, preferably water. The reservoir is integrally formed with the inner surface 26 of the sneaker, preferably adjacent to one side thereof adjacent the instep. The reservoir is fabricated of a fluid-impervious material such as a plastic or rubber, natural or synthetic including blends thereof. The reservoir includes an air-input port 28. It also includes a vapor output 30.

In addition, the reservoir also includes a cap 32 loaded outwardly by a spring 34. The cap extends through an aperture 36 in the wall of the sneaker thereadjacent. This is for communicating with the exterior of the sneaker. The cap includes a spring spanning the opposite sides of the reservoir tending to urge the cap into a closed position. Note FIG. 6. This is for sealing the fluid within the reservoir. The cap is adapted to move to a loading position for providing supplemental fluid to the reservoir.

Next provided with respect to the sneaker is a container 38. The container is a bottle, preferably plastic, and has a rigid snout 40. The snout is adapted to contact and depress the cap to the loading position. The container is formed with resilient side walls 42 for being squeezed. When squeezed, the container will dispense liquid 44 from the container through the snout into the reservoir for supplementing the fluid therein so long as the snout is contacting and depressing the cap.

An atomizer 48 is the next component element of the sneaker. The atomizer is located in the upper tongue of the sneaker. The atomizer is formed in a hemispherical configuration. Note FIGS. 1, 2, 3 and 5. The atomizer includes a ball-check valve 50 with an aperture 52 centrally located on the upper surface thereof. The atomizer is adapted to urge air from interior of the atomizer upon its depression. It is also adapted to refill with air upon the release of the atomizer and its return to the orientation of FIG. 5. The atomizer includes a first line 54. Such line couples the interior of the atomizer with the input port of the reservoir. In this manner, pressure within the atomizer is increased upon the depression of the atomizer to increase the pressure in the upper region of the reservoir.

The last component of the sneaker is a spray nozzle 58. The spray nozzle is in fluid communication with the bottom 60 of the sole of the sneaker at a location adjacent to a forward extent thereof. A second line 64 extends from the nozzle through the output port of the reservoir to a lower region of the reservoir. In this manner, when the atomizer increases the pressure within the reservoir, the fluid therein will be forced outwardly. It will then move through the second line to the nozzle for being dispensed therefrom as a vapor. Such vapor functions for moistening the lower surface of the sole to increase the traction thereof during operation and use.

The present invention allows a player maximum traction at the push of a button. Basketball players always have traction problems, so they spit on the hardwood court or wipe sweat on the soles of their shoes which gives them temporary traction. However, they get dust and dirt on their hands making them slick.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved sneaker with built in atomizer for improved traction comprising, in combination:

a sneaker with built in atomizer for improved traction having a sole, an upper, a tongue and laces;

a reservoir for liquid integrally formed on the inner surface of the sneaker with built in atomizer for improved traction, the reservoir being fabricated of a fluid-impervious material with an air input port and a vapor output port and a spring loaded cap extending through an aperture thereof for communicating with the exterior of the sneaker with built in atomizer for improved traction, the cap including a spring urging the cap into a closed position for sealing fluid within the reservoir and adapted to be moved to a loading position for providing supplemental fluid to the reservoir;

a liquid container with a rigid snout adapted to contact and depress the cap to the loading position, the container having resilient side walls for being squeezed to dispense liquid from the container through the snout into the reservoir for supplementing the fluid therein when the snout is contacting and depressing the cap;

an atomizer located in the upper tongue of the sneaker with built in atomizer for improved traction, the atomizer being formed in a hemispherical configuration with a ball-check valve and aperture centrally located on an upper surface thereof, the atomizer adapted to urge air therefrom upon depression and to allow the refilling thereof with air upon release of the atomizer, the atomizer including a first line coupling the interior of the atomizer with the input port of the reservoir whereby pressure within the atomizer is increased upon the depression of the atomizer; and a spray nozzle in fluid communication with the bottom of the sole of the sneaker with built in atomizer for improved traction adjacent to a forward extent thereof, and a second line extending from the nozzle through the output port to a lower region of the interior of the reservoir whereby when the atomizer increases the pressure within the reservoir, the fluid therein will move through the second line to the nozzle for being dispensed therethrough as a vapor for moistening the lower surface of the sole to increase the traction thereof.

2. A sneaker with built in atomizer for improved traction comprising:

a sneaker with built in atomizer for improved traction having a sole, an upper, a tongue and laces;

an atomizer located in the upper tongue of the sneaker with built in atomizer for improved traction, the atomizer being formed in a hemispherical configuration with a valve and aperture centrally located on an upper surface thereof, the atomizer adapted to urge air therefrom upon depression and to allow the refilling thereof with air upon release of the atomizer, the atomizer including a first line coupling the interior of the atomizer with the input port of a reservoir whereby pressure within the atomizer is increased upon the depression of the atomizer; and a spray nozzle in fluid communication with the bottom of the sole of the sneaker with built in atomizer for improved traction and a second line extending from the nozzle through the output port to a lower region of the interior of the reservoir whereby when the atomizer increases the pressure within the reservoir, fluid therein will move through the second line to the nozzle for being dispensed therethrough as a vapor for moistening the lower surface of the sole to increase the traction thereof.

3. The sneaker with built in atomizer for improved traction as set forth in claim 2 and further including:

a reservoir for liquid integrally formed on the inner surface of the sneaker with built in atomizer for improved traction, the reservoir being fabricated of a fluid-impervious material with an air input port and a vapor output port and a spring loaded cap extending through an aperture thereof for communicating with the exterior of the sneaker with built in atomizer for improved traction, the cap including a spring urging the cap into a closed position for sealing fluid within the reservoir and adapted to be moved to a loading position for providing supplemental fluid to the reservoir.

4. The sneaker with built in atomizer for improved traction as set forth in claim 3 and further including:

a liquid container with a rigid snout adapted to contact and depress the cap to the loading position, the container having resilient side walls for being squeezed to dispense liquid from the container through the snout into the reservoir for supplementing fluid therein when the snout is contacting and depressing the cap.

* * * * *